US008323035B2

(12) United States Patent
Read

(10) Patent No.: US 8,323,035 B2
(45) Date of Patent: Dec. 4, 2012

(54) 60 GHZ DATA TRANSMISSION THROUGH A MECHANICAL SWIVEL CONNECTION

(75) Inventor: Christopher Jensen Read, San Diego, CA (US)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 12/750,821

(22) Filed: Mar. 31, 2010

(65) Prior Publication Data

US 2011/0244696 A1 Oct. 6, 2011

(51) Int. Cl.
*H01R 39/00* (2006.01)

(52) U.S. Cl. ..... 439/22

(58) Field of Classification Search ..... 439/13, 439/18, 20–28, 32, 33; 333/254, 255, 256, 333/257, 261; 343/901, 762
See application file for complete search history.

(56) References Cited

U.S. PATENT DOCUMENTS

| | | | | |
|---|---|---|---|---|
| 2,644,028 | A * | 6/1953 | Bernet | 174/88 C |
| 3,585,564 | A * | 6/1971 | Skjervoll | 439/21 |
| 6,830,456 | B2 * | 12/2004 | Obermeyer | 439/6 |
| 7,223,917 | B1 | 5/2007 | Marszalek et al. | |
| 7,374,424 | B1 | 5/2008 | Nurmi et al. | |
| 2008/0171456 | A1 | 7/2008 | Vanzo et al. | |
| 2009/0056972 | A1 | 3/2009 | Dlugas et al. | |

FOREIGN PATENT DOCUMENTS

| | | |
|---|---|---|
| EP | 1187261 | 3/2002 |
| JP | 2001154760 | 6/2001 |
| WO | WO-2006128239 | 12/2006 |

* cited by examiner

*Primary Examiner* — Ross Gushi
(74) *Attorney, Agent, or Firm* — Fitch, Even, Tabin & Flannery, LLP

(57) ABSTRACT

A swivel mechanism comprising a first swivel portion having a first coupling portion and a second swivel portion having a second coupling portion, the second swivel portion dimensioned for mechanically engaging with the first swivel portion to provide at least a first mechanical coupling position and at least a first data communication channel, wherein the first data communication channel is provided through a hollow cavity formed when the first swivel portion and the second swivel portion are in the first mechanical coupling position and wherein the first data communication channel is configured to convey 60 GHz data signals when the first swivel portion and the second swivel portion are in the first mechanical coupling position.

20 Claims, 4 Drawing Sheets

60 GHZ DATA TRANSMISSION THROUGH A MECHANICAL SWIVEL CONNECTION

BACKGROUND OF THE INVENTION

1. Field of the Invention

The present invention relates generally to a swivel mechanism, and more specifically to 60 GHz data transmission through a mechanical swivel connection.

2. Discussion of the Related Art

Completely freely movable swivel connections are difficult to transmit signals through. Continuous rotating in the same direction will eventually twist any connected wires until they break. It is possible to have one wire going through the middle of the swivel junction if it too swivels. However, if you need high bandwidth, a single connector may not be sufficient.

One solution is to limit how far a swivel can actually turn, (perhaps −/+400 degrees), which would allows more than 2 full turns, but would not allow continuous free rotation. This is implemented with multiple flexible wires through the center of the swivel. The −/+400 degrees limitation means that the wires will have a limited number of turns, and will not allow indefinite rotation in the same direction.

Another approach that actually gives the freedom of continuous rotation in the same direction is to have concentric contacts on a flat surface rotation. Each contact may support one signal on the surface of rotation. However, this method has the disadvantage of signal loss due to the varying contact as it rotates. These mechanical contacts also wear out.

SUMMARY OF THE INVENTION

Several embodiments of the invention advantageously address the needs above as well as other needs by providing a swivel mechanism comprising a first swivel portion having a first coupling portion and a first electrically conductive portion and a second swivel portion having a second coupling portion and a second electrically conductive portion, the second swivel portion dimensioned for mechanically engaging with the first swivel portion to provide at least a first mechanical coupling position and at least a first data communication channel, wherein the first electrically conductive portion is in electrical contact with the second electrically conductive portion when the first swivel portion and the second swivel portion are in the first mechanical coupling position and the first data communication channel configured to convey 60 GHz data signals when the first swivel portion and the second swivel portion are in the first mechanical coupling position.

In one embodiment, the invention can be characterized as a method for providing data communication means for a device, comprising providing a first swivel portion having a first coupling portion and providing a second swivel portion having a second coupling portion, the second swivel portion dimensioned for mechanically engaging with the first swivel portion to provide at least a first mechanical coupling position and at least a first data communication channel, wherein the first data communication channel is provided through a hollow cavity formed when the first swivel portion and the second swivel portion are in the first mechanical coupling position and wherein the first data communication channel is configured to convey 60 GHz data signals when the first swivel portion and the second swivel portion are in the first mechanical coupling position.

BRIEF DESCRIPTION OF THE DRAWINGS

The above and other aspects, features and advantages of several embodiments of the present invention will be more apparent from the following more particular description thereof, presented in conjunction with the following drawings.

Figure 1B:
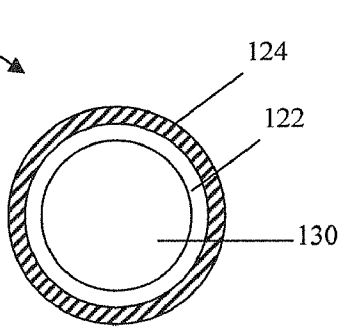
FIG. 1B illustrates an exemplary second swivel portion of a swivel mechanism, according to one embodiment of the present invention.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention.

DETAILED DESCRIPTION

The following description is not to be taken in a limiting sense, but is made merely for the purpose of describing the general principles of exemplary embodiments. The scope of the invention should be determined with reference to the claims.

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided, such as examples of programming, software modules, user selections, network transactions, database queries, database structures, hardware modules, hardware circuits, hardware chips, etc., to provide a thorough understanding of embodiments of the invention. One skilled in the relevant art will recognize, however, that the invention can be practiced without one or more of the specific details, or with other methods, components, materials, and so forth. In other instances, well-known structures, materials, or operations are not shown or described in detail to avoid obscuring aspects of the invention.

In some embodiments, the swivel mechanism of the current invention provides a method of transmitting data through the core of a swivel using a 60 GHz wireless transmission. The swivel mechanism provides for very high bandwidth secure communication of data. The mechanism is robust because it allows the communication of data without the use of a mechanical connection and wires. As 60 GHz signals, unlike wireless and other RF signals do not pass through walls, the system provides a secure data communication as it will be encapsulated inside the swivel, and therefore wouldn't be receivable outside the connection. The mechanism is robust because it allows the communication of data without the use of a mechanical connection and wires, therefore, limiting the number of mechanical connections. Additionally, the mechanism allows for the freedom of continuous rotation in the same direction by limiting the number of wires and mechanical contacts needed.

In one or more embodiments, the swivel mechanism provides a swivel connection through a center contact of the swivel. This center contact is used to deliver power to the swiveling component from the external stationary component. In some embodiments, the center component is further used to send data at a lower speed, at a frequency above that used by the power. In one embodiment, the center contact may act as a low speed data channel that travels (along with transmitted power) over the mechanical/electrical swivel and possibly center rod. In one embodiment, the power connector may be insulated to improve the ability to send data, the insulator may be used as a transmission line for the 60 GHz signal.

In one embodiment, the swivel mechanism further provides a center hollow portion through which 60 GHz signal transmission is performed. That is, in one or more embodiments, high speed data transmission is provided through the hollow center of the swivel. In one embodiment, the data communication channel may carry up to 5 Gbps of data. In one embodiment, the 5 Gbps channel can carry uncompressed high definition video signals.

Figure 1A:
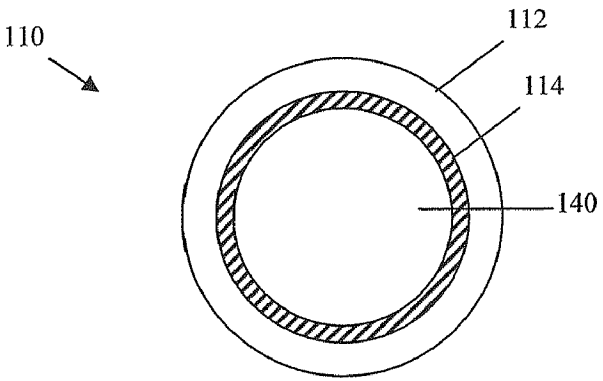
FIG. 1A illustrates an exemplary first swivel portion of a swivel mechanism, according to one embodiment of the present invention.

Referring first to FIGS. 1A and 1B, an exemplary swivel core of a swivel mechanism is shown according to one embodiment of the present invention. The swivel core comprises a first swivel portion 110, shown in FIG. 1A, and a second swivel portion 120, shown in FIG. 1B. As shown in FIG. 1A, in some embodiments, the first swivel portion comprises an outer wall 112, an electrically conductive portion 114, and a conduit 140. Similarly, as shown in FIG. 1B, the second swivel portion 120 comprises an inner wall 122, an electrically conductive portion 124 and a hollow portion 130.

In one embodiment, the first swivel portion comprises a first coupling portion and the second swivel portion comprises a second coupling portion, the second coupling portion dimensioned for mechanically engaging with the first coupling portion to provide at least a first mechanical coupling position and at least a first data communication channel. In some embodiments, for example, the first conduit 140 is configured to have a diameter that is approximately equal to the outer diameter of the second swivel portion.

Figure 2:
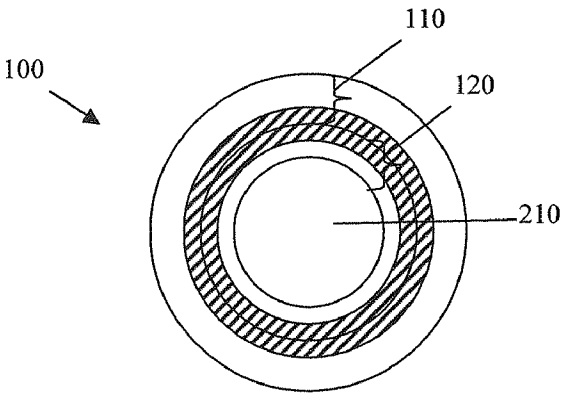
FIG. 2 illustrates an exemplary swivel core of a swivel mechanism, according to one embodiment of the present invention.

As shown in FIG. 1, in one embodiment, the first swivel portion 110 comprises a first conduit 140, and the second swivel portion 120 comprising a second conduit 130. According to several embodiments, as shown in FIG. 2, the first swivel portion 110 and the second swivel portion 120 are positioned relative to each other to form the first data communication channel 210 when the first swivel portion and the second swivel portion are in the first mechanical coupling position. As shown, the second swivel portion 120 is configured to fit within the first conduit 140 of the first swivel portion 110. In one embodiment, the first swivel portion and the second swivel portion are such that the second swivel portion fits within the conduit 140 of the first swivel portion 110 and rotates freely within the hollow portion.

In one embodiment, the first electrically conductive portion 114 of the first swivel portion 110 forms an inner wall of the first swivel portion, and the second electrical conductive portion 124 of the second swivel portion 120 forms an outer wall of the second swivel portion. In one embodiment the first electrically conductive portion 114 is positioned on the inner portion outer wall 112 of the first swivel portion, the first electrically conductive portion 114 having an inner diameter. Further, in some embodiments, the second electrically conductive portion 124 is positioned around at least a portion of the outer surface of the inner wall of the second swivel portion 120, the second electrically conductive portion having an outer diameter dimensioned to match the inner diameter of the first electrically conductive portion 114.

In one embodiment, the first swivel portion and the second swivel portion are coupled such that the first electrically conductive portion is in electrical contact with the second electrically conductive portion. According to one embodiment, as shown in FIG. 2, the conduit 140 of the first swivel portion 110 receives the second swivel portion providing the first mechanical coupling position as shown in FIG. 2. In one embodiment, the data communication channel 210 comprises a cavity formed between the first swivel portion 110 and the second swivel portion 120 when the first swivel portion and the second swivel portion are in the first mechanical coupling position. In one embodiment, when the first swivel portion and the second swivel portion are mechanically engaged, as shown in FIG. 2, the conduit 130 of the second swivel portion comprises the data communication channel 210. In one embodiment, the conduit is used to send 60 GHz signals.

In some embodiments, the data communication channel 210 is configured to convey 60 GHz data signals when the first coupling section and the second coupling section are in the first mechanical coupling position.

In some embodiments, the swivel mechanism may comprise a cylindrical rod swivel used to provide power and data communication for a swiveling device. In such embodiment, the first swivel portion 110 and/or the second swivel portion 120 may each comprise a cylindrical rod having a hollow portion and/or having a circular cross section similar to that of FIGS. 1A and 1B. In one embodiment, power is conducted through the swivel mechanism through a first electrical connection which carries power. In another embodiment, a second connection provides a ground or null reference. In one embodiment, each of the connections may be incorporated into the rod or swivel portions, and/or housed within the rod or swivel portions. In one embodiment, both data and power can be transmitted through the connection and/or connections. In one embodiment, the data transmitted through the connection is in addition to the data transmitted through the center of the swivel through the 60 GHz transmission.

In several embodiments, the first swivel portion and the second swivel portion are configured to be coupled to a first device having a first device component and a second device component, wherein the first swivel portion is configured to be mechanically coupled to the first device component and the second swivel portion is configured to be mechanically coupled to the second device component, such that the first and second device parts are mechanically coupled to one another and the first and second device parts are movable relative to one another. In several embodiments, the swivel mechanism enables the first device component and the second device component to rotate relative to one another with a degree of freedom that is equal to or greater than 360 degrees. In one embodiment, the swivel mechanism allows continuous rotational freedom by reducing the number of wires and mechanical connections needed to convey signals while providing power to the swiveling device component.

Figure 3:
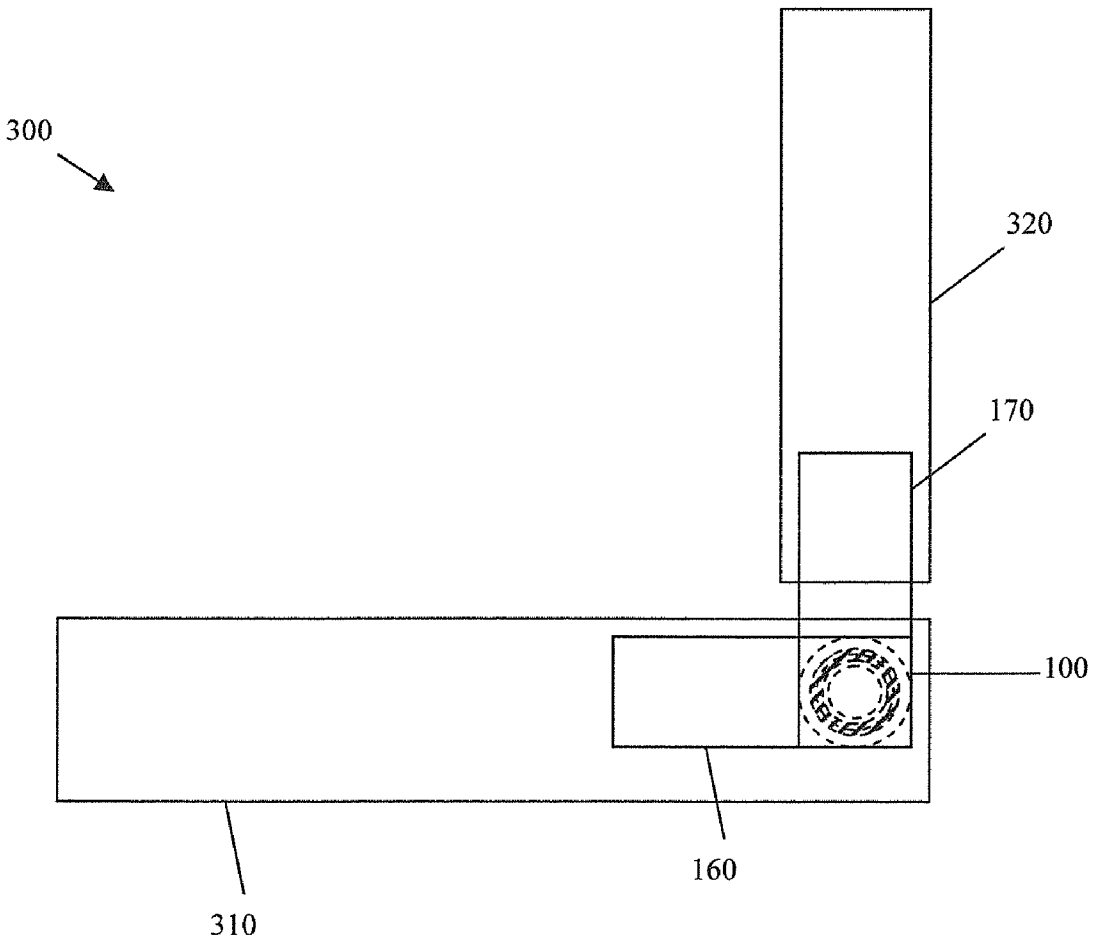
FIG. 3 illustrates an example of the swivel mechanism being implemented for use with a device, according to several embodiments of the present invention.

FIG. 3 illustrates an example of the swivel mechanism being implemented for use with a device 300, according to several embodiments. As shown, in this embodiment, the swivel mechanism may be implemented such that the first swivel portion 110 comprises a first connection section 160, and the second swivel portion 120 comprises a second connection section 170. As shown in FIG. 3, the device 300 has a first device component 310 and a second device component 320. In one embodiment, the first device component comprises a stationary device component, and the second device portion comprises a swiveling device component. In another embodiment, both the first device portion and the second device portion may swivel with respect to one another. In one embodiment, the connection section 160 of the first swivel portion is mounted on the first device component 310, and the connection 170 of the second swivel portion is mounted on the second device component 320.

In one embodiment, while the first swivel portion and the second swivel portion are in the first mechanical position, and engaged with the device 300, the first device component 310 and the second device component 320 can receive electrical power and send and receive 60 GHz data signals to and/or from one another. In one embodiment, the swivel mechanism 100 will allow one or both of the first device component 310 and the second device component 320 of device 300 to freely rotate with respect to one another. In several embodiments, the swivel mechanism enables the first device component and the second device component to rotate relative to one another with a degree of freedom that is equal to or greater than 360 degrees. In one embodiment, the swivel mechanism allows continuous rotational freedom by reducing the number of wires and mechanical connections needed to convey signals and provides power to the swiveling device component.

In one embodiment, the swivel mechanism of FIG. 1 may be used for providing power and data in a security camera. In one embodiment, the security camera may comprise a dome shaped camera structure.

Figure 4:
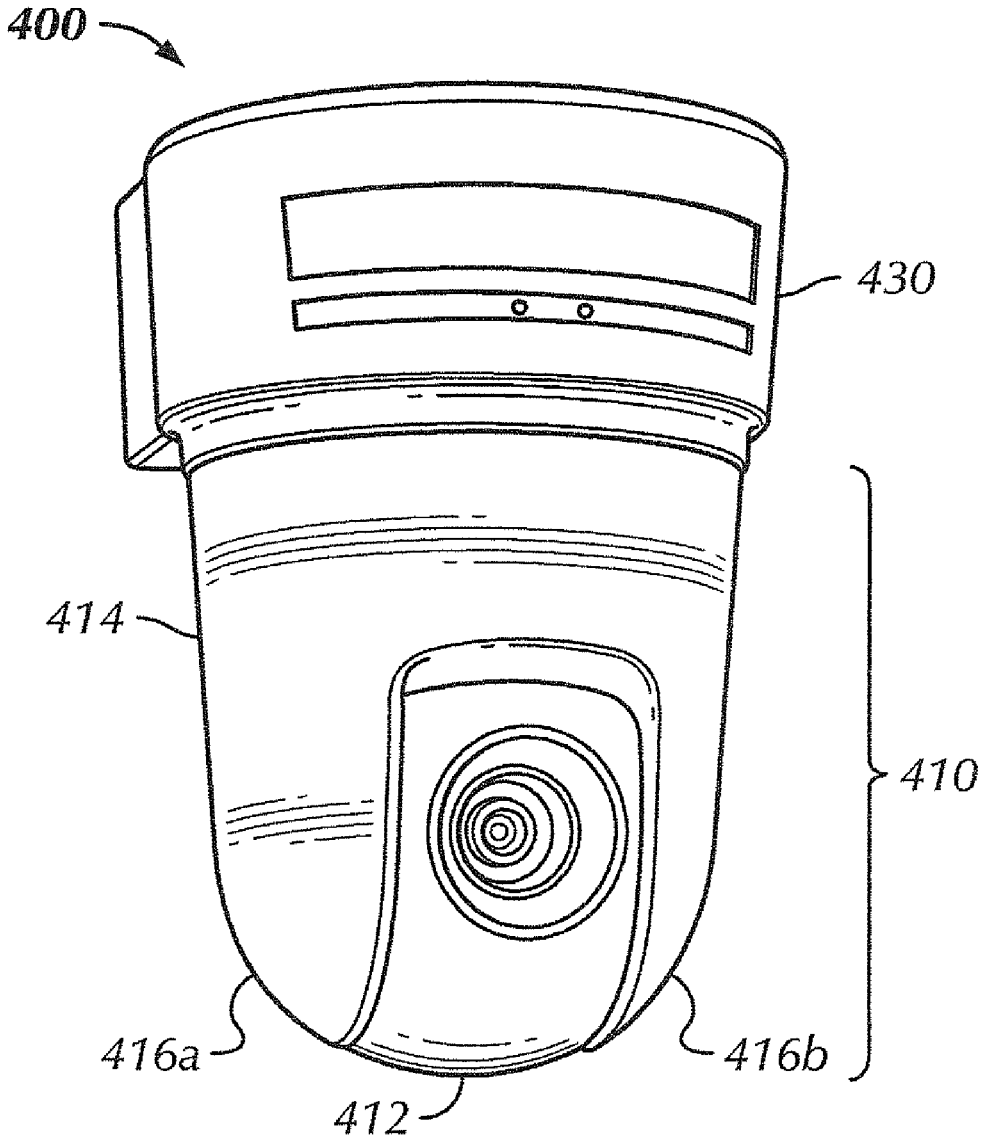
FIG. 4 illustrates an exemplary camera device comprising a swivel mechanism, according to several embodiments of the present invention.

FIG. 4 depicts an exemplary camera device 400 comprising a swivel mechanism 100, according to several embodiments of the present invention.

The camera of FIG. 4 comprises a camera portion 410 comprising a semispherical camera 412, and a support structure 414, and a base 430. In one embodiment, the base 430 may comprise a swivel portion similar to the first swivel portion 110 and/or the second swivel portion 120 and the camera portion 410 may further comprise a first or second swivel portion. The base 430 and the camera portion 410 may be configured to be in contact by the swivel structure, such that the camera portion can receive electrical power and send and receive 60 GHz data signals to and from the base portion. In some embodiments, the swivel mechanism 100 will allow the camera portion 410 to freely rotate with respect to the base 430.

In one embodiment, the camera portion 410 and the base 430 are able to transmit and receive 60 GHz data signals to and from one another through the data communication channel. The system provides for very high bandwidth secure communication of data. The system is robust because it allows the communication of data without the use of a mechanical connection and wires. As 60 GHz signals, unlike wireless and other RF signals do not pass through walls, in several embodiments, the swivel mechanism provides a secure data communication as it will be encapsulated inside the swivel, and therefore would not be receivable outside the connection. In one embodiment, the high frequency 60 GHz data transmission channel enables the camera portion 410 to transmit uncompressed video signals to the base 430.

In several embodiments, the swivel mechanism enables the camera portion 410 and the base 430 to rotate relative to one another with a degree of freedom that is equal to or greater than 360 degrees. In one embodiment, the swivel mechanism allows continuous rotational freedom by reducing the number of wires and mechanical connections needed to convey signals and provides power to the swiveling device.

In some embodiments, the support structures 414 comprises two arms 416 *a* and 416 *b*. In one embodiment, each arm may comprise a swivel portion similar to the first swivel portion 110 depicted in FIG. 1A, and the camera 412 may comprise two swivel portions similar to the second swivel portion 120 depicted in FIG. 1B in either side. The swivel portions are configured to fit within one another when the camera 412 and the support structure 414 are attached to one another to provide an electrical coupling and data communication channel for conveying 60 GHz signals from the camera to the base.

In another embodiment, the mechanical swivel mechanism of FIG. 1 may be used in a motor device to get data from the rotor out to the stator, such that high speed sensors could be used inside the motor and transmit the data outside.

Figure 5:
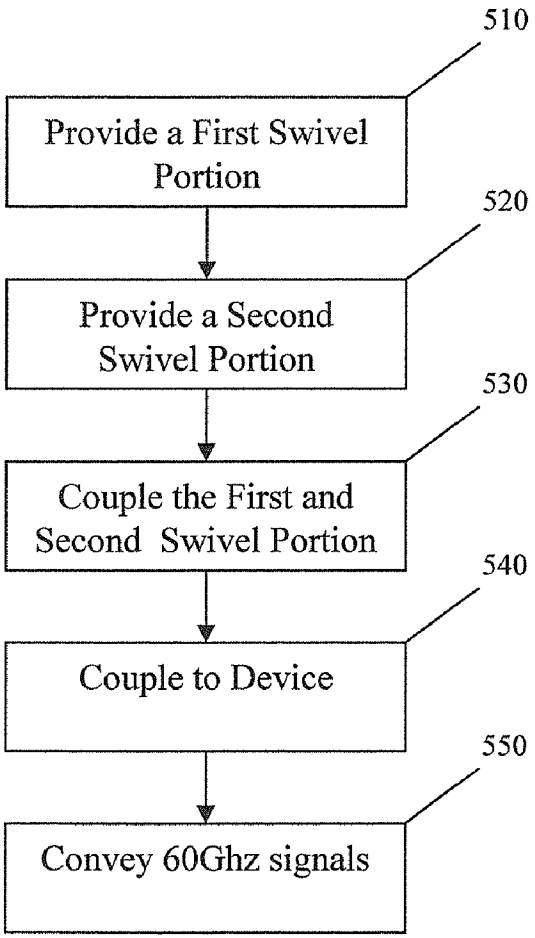
FIG. 5 illustrates a flow diagram of a method for conveying signals through a swivel mechanism for use with a device, according to several embodiments of the present invention.

FIG. 5 illustrates a flow diagram of a method for conveying signals through a swivel mechanism for use with a device, according to several embodiments. In one embodiment, the method provides power and data communication means for a device having multiple components, wherein in some embodiments, the device comprise a swiveling device component and a stationary device component. In one embodiment, the stationary device component provides power to the swiveling device component through the swivel mechanism, and further in some embodiments, the stationary device component and swiveling device parts are able to send/receive 60 GHz data to and from one another through the swivel mechanism.

The method 500 begins in step 510 where a first swivel portion is provided having an outer wall, a first conduit and a first electrically conductive portion. Next, in step 520, a second swivel portion having a second conduit, an inner wall and a second electrically conductive portion is provided. In some embodiments, the second swivel portion is dimensioned for mechanically engaging with the first swivel portion to provide at least a first mechanical coupling position and at least a first data communication channel. For example, in one embodiment, the second swivel portion is dimensioned to fit within the first conduit of the first swivel portion.

In one embodiment, the first electrical conductive portion of the first swivel portion forms an inner wall of the first swivel portion, and the second electrical conductive portion of the second swivel portion forms an outer wall of the second swivel portion. According to one embodiment, the first electrically conductive portion is positioned on the inner portion of the outer wall of the first swivel portion, the first electrically conductive portion having an inner diameter. Further, in some embodiments, the second electrically conductive portion is positioned around at least a portion of the outer surface of the inner wall of the second swivel portion, the second electrically conductive portion having an outer diameter dimensioned to match the inner diameter of the first electrically conductive portion.

In step 530, the first swivel portion and the second swivel portion are coupled together to provide at least a first mechanical coupling position. In some embodiments, the mechanical coupling position is configured to provide a contact between the electrically conductive portions of the first swivel portion and the second swivel portion to provide a means of conveying power through the swivel mechanism. In one embodiment, the second swivel portion is inserted into the first swivel portion. In some embodiments, the first conduit of the first swivel portion is dimensioned to receive the second swivel portion.

In some embodiments, the first swivel portion and the second swivel portion are coupled such that the first electrically conductive portion is in electrical contact with the second electrically conductive portion when the first coupling section and the second coupling section are in the first mechanical coupling position. In one embodiment, once the first swivel portion is coupled with the second swivel portion, the first electrically conductive portion and the second electrically conductive portion come into contact, and provide means for delivering power from a first component of a device to another component of the device.

In one embodiment, the first mechanical coupling position further provides a data communication channel. In one embodiment, in step 530, the first swivel portion and the second swivel portion are coupled, a first data communication channel is formed through the conduit of the second swivel portion. In one embodiment, the first data communication channel is configured to convey 60 GHz data signals when the first swivel portion and the second swivel portion are in the first mechanical coupling position.

Next, in step 540, the first swivel portion and the second swivel portion are each coupled to a first and second component of a device. In one embodiment, the first swivel portion is coupled to a first device component of the device and the second swivel portion is coupled to a second device component of the device. In one embodiment, the first component of the device comprises a stationary component and the second component of the device comprises a swiveling component. In one embodiment, coupling the swivel portions to device components comprises mechanically coupling the first swivel portion to the first device component, and mechanically coupling the second swivel portion to the second device component such that the first and second device components are mechanically coupled and are movable relative to one another.

Next, in step 550, 60 GHz signals and power is delivered between the stationary device component and the swiveling device component. In several embodiments, the swivel mechanism enables the first device component and the second device component to rotate relative to one another with a degree of freedom that is equal to or greater than 360 degrees. In one embodiment, the swivel mechanism allows continuous rotational freedom by reducing the number of wires and mechanical connections needed to convey signals.

While the invention herein disclosed has been described by means of specific embodiments, examples and applications thereof, numerous modifications and variations could be made thereto by those skilled in the art without departing from the scope of the invention set forth in the claims.

What is claimed is:

1. A swivel mechanism comprising:

a first swivel portion having a first electrically conductive portion and an outer wall, the outer wall positioned adjacent the first electrically conductive portion with the first electrically conductive portion positioned on an inner portion of the outer wall; and a second swivel portion having a second electrically conductive portion and an inner wall, the inner wall positioned adjacent to the second electrically conductive portion with the second electrically conductive portion positioned around at least a portion of an outer surface of the inner wall, and where the inner wall is separated from the outer wall portion of the first swivel portion by the first electrically conductive portion and the second electrically conductive portion, the second swivel portion dimensioned for mechanically engaging with the first swivel portion to provide at least a first mechanical coupling position and at least a first data communication channel, where the second swivel portion is within the first swivel portion;

wherein the first data communication channel is provided through a center hollow cavity formed when the first swivel portion and the second swivel portion are in the first mechanical coupling position and where the data communication channel is interior to both the first and second conductive portions through the center hollow cavity; and wherein the first data communication channel is configured to wirelessly convey 60 GHz data signals when the first swivel portion and the second swivel portion are in the first mechanical coupling position such that the wireless 60 GHz data signals are communicated along the first data communication channel without being carried by a conductor, first electrically conductive portion or the second electrically conductive portion and are encapsulated inside the first data communication channel while being communicated along the first data communication channel and do not pass through the first electrically conductive portion and the second electrically conductive portion.

2. The swivel mechanism of claim 1, wherein the first electrically conductive portion is in electrical contact with the second electrically conductive portion and the second electrically conductive portion is received within an outer conduit defined by the first electrically conductive portion when the first swivel portion and the second swivel portion are in the first mechanical coupling position and are rotational relative to each other.

3. The swivel mechanism of claim 2, wherein the first data communication channel comprises a conduit within the second swivel portion with the first swivel portion and the second swivel portion positioned in the first mechanical coupling position.

4. The swivel mechanism of claim 2, the first swivel portion comprises a first conduit;

the second swivel portion comprises a second conduit;

wherein the first electrically conductive portion of the first swivel portion is positioned within the first swivel portion forming the first conduit having an inner diameter; and wherein the second electrically conductive portion of the second swivel portion is disposed around at least a portion of the second swivel portion, and having a outer diameter dimensioned to match the inner diameter of the first electrically conductive portion such that the second swivel portion is configured to fit within the first conduit of the first swivel portion such that the first electrically conductive portion of the first swivel portion is in electrical contact with the second electrically conductive portion of the second swivel portion; and wherein with the second swivel portion positioned within the first conduit of the first swivel portion in the first mechanical coupling position, the second conduit defines the center hollow cavity providing the first data communication channel.

5. The swivel mechanism of claim 1, wherein the first electrically conductive portion comprises a first conduit, wherein the second swivel portion is dimensioned to fit within the first conduit to provide at least the first mechanical coupling position.

6. The swivel mechanism of claim 5, wherein the second swivel portion comprises a second conduit, and wherein when the first swivel portion and the second swivel portion are in the first mechanical coupling position, the first data communication channel is created inside the second conduit.

7. The swivel mechanism of claim 1, wherein the first swivel portion and the second swivel portion are configured to be coupled to a first device having a first device part and a second device part, wherein the first swivel portion is configured to be mechanically coupled to the first device part and the second swivel portion is configured to be mechanically coupled to the second device part, such that the first device part and the second device part are mechanically coupled to one another and the first device part and the second device part are movable relative to one another.

8. The swivel mechanism of claim 7, wherein further the first device part and the second device part are able to transmit and receive 60 GHz data signals to and from one another through the first data communication channel, and where electric power is delivered from the first device part through the first electrically conductive portion and the second electrically conductive portion and provided to the second device part to power the second device part.

9. The swivel mechanism of claim 7, wherein the first device part and the second device part are configured to rotate relative to one another with a degree of freedom that is greater than 360 degrees.

10. The swivel mechanism of claim 7, wherein the first part comprises a camera portion and the second device part comprises a base structure configured to receive the camera portion, such that the camera portion is able to rotate within the base structure.

11. The swivel mechanism of claim 1, wherein the first electrically conductive portion and the second electrically conductive portion are a secondary communication path with secondary communications communicated through the first electrically conductive portion and the second electrically conductive portion in addition to the 60 GHz data signals wirelessly conveyed through the first data communication channel.

12. A method for providing data communication channel for a device, comprising:

providing a first swivel portion having a first electrically conductive portion and an outer wall, the outer wall positioned adjacent the first electrically conductive portion with the first electrically conductive portion positioned on an inner portion of the outer wall; and providing a second swivel portion having a second electrically conductive portion and an inner wall, the inner wall positioned adjacent to the second electrically conductive portion with the second electrically conductive portion positioned around at least a portion of an outer surface of the inner wall, and where the inner wall is separated from the outer wall portion of the first swivel portion by the first electrically conductive portion and the second electrically conductive portion, the second swivel portion dimensioned for mechanically engaging with the first swivel portion to provide at least a first mechanical coupling position and at least a first data communication channel, where the second swivel portion is within the first swivel portion;

wherein the first data communication channel is provided through a center, empty hollow cavity formed when the first swivel portion and the second swivel portion are in the first mechanical coupling position and where the data communication channel is interior to both the first and second conductive portions; and wherein the first data communication channel is configured to wirelessly convey 60 GHz data signals when the first swivel portion and the second swivel portion are in the first mechanical coupling position such that the wireless 60 GHz data signals are communicated along the first data communication channel without being carried by a conductor, first electrically conductive portion or the second electrically conductive portion and are encapsulated inside the first data communication channel while being communicated along the first data communication channel and do not pass through the first electrically conductive portion and the second electrically conductive portion.

13. The method of claim 12, wherein the first electrically conductive portion is in electrical contact with the second electrically conductive portion when the first swivel portion and the second swivel portion are in the first mechanical coupling position.

14. The method of claim 13, further comprising:

positioning the first electrically conductive portion within the first swivel portion, the first electrically conductive portion having an inner diameter; and positioning the second electrically conductive portion around at least a portion of the second swivel portion, the second electrically conductive portion having an outer diameter dimensioned to match the inner diameter of the first electrically conductive portion.

15. The method of claim 12, the first electrically conductive portion comprising a first conduit, wherein the second swivel portion is dimensioned to fit within the first conduit to provide at least the first mechanical coupling position.

16. The method of claim 15, wherein the second swivel portion comprises a second conduit, and wherein when the first swivel portion and the second swivel portion are in the first mechanical coupling position, the first data communication channel is created through the second conduit.

17. The method of claim 12, further comprising:

coupling the first swivel portion to a first device part of the device; and coupling the second swivel portion to a second device part of the device.

18. The method of claim 17, wherein the coupling comprises mechanically coupling the first swivel portion to the first device part, and mechanically coupling the second swivel portion to the second device part such that the first device part and the second device part are mechanically coupled to one another and the first device part and the second device part are movable relative to one another.

19. The method of claim 17, wherein further the first device part and the second device part are able to wirelessly transmit and receive the 60 GHz data signals to and from one another through the first data communication channel.

20. The method of claim 19, wherein the first device part and the second device part are configured to rotate relative to one another with continuous rotational freedom.

* * * * *

UNITED STATES PATENT AND TRADEMARK OFFICE

CERTIFICATE OF CORRECTION

PATENT NO. : 8,323,035 B2
APPLICATION NO. : 12/750821
DATED : December 4, 2012
INVENTOR(S) : Read It is certified that error appears in the above-identified patent and that said Letters Patent is hereby corrected as shown below:

In the CLAIMS:

Claim 10, column 9, line 32, delete "first part" and insert --first device part--.

Signed and Sealed this
Fourth Day of June, 2013

Teresa Stanek Rea
*Acting Director of the United States Patent and Trademark Office*